US006202227B1

(12) United States Patent
Gurowitz

(10) Patent No.: US 6,202,227 B1
(45) Date of Patent: Mar. 20, 2001

(54) AUTOMATIC TOILET FLUSHING SYSTEM

(76) Inventor: John Gurowitz, 21021 Vanowen St. Suite B212, Canoga Park, CA (US) 91303

( * ) Notice: Subject to any disclaimer, the term of this patent is extended or adjusted under 35 U.S.C. 154(b) by 0 days.

(21) Appl. No.: 09/263,388

(22) Filed: Mar. 5, 1999

(51) Int. Cl.[7] ..... E03D 5/10
(52) U.S. Cl. ..... 4/313; 4/406
(58) Field of Search ..... 4/406, 313, DIG. 3, 4/302, 304, 355

(56) References Cited

U.S. PATENT DOCUMENTS

| | | | | |
|---|---|---|---|---|
| 1,192,767 | * | 7/1916 | Dyer | 4/353 |
| 4,233,698 | * | 11/1980 | Martin | 4/354 |
| 5,003,643 | * | 4/1991 | Chung | 4/313 |
| 5,603,127 | * | 2/1997 | Veal | 4/246.1 |
| 5,901,384 | * | 5/1999 | Sim | 4/313 |
| 5,920,918 | * | 7/1999 | Thomas | 4/353 |

FOREIGN PATENT DOCUMENTS

06306913 * 11/1994 (JP) .

* cited by examiner

*Primary Examiner*—Henry J. Recla
*Assistant Examiner*—Huyen Le
(74) *Attorney, Agent, or Firm*—Robert J. Schaa

(57) ABSTRACT

An automatic toilet flushing system for use with toilets in either commercial or private dwellings and which comprises a replaceable water tank top or tank lid carrying the major components of the automatic toilet flushing system. In this case, the toilet flushing system is an adaptive system, since it converts a conventional toilet into an automatic flushing toilet. The adaptive system also comprises a pair of infrared light sources and sensors located on forwardly protruding portions of the tank lid. The sensors are located forwardly of the water tank or water chest of the toilet and the timing is adjusted so that raising and lowering of the lid of the toilet seat will not interfere with operation of the sensors. A control circuit is also provided and mounted on the underside of the replaceable water tank cover plate. The circuit is connected to the sensors and operated by batteries so that when a light beam is interrupted for at least a predetermined time period, the control circuit will automatically initiate a flushing operation. The circuit initiates a flushing signal to a solenoid which shifts a connecting rod and which, in turn, is connected to a flapper valve at the lower end of the water chest. Thus, when the light beam is interrupted for the predetermined time period, the control circuit causes the solenoid to operate the rod which opens the flapper valve and thereby causes a flushing operation of the toilet.

24 Claims, 2 Drawing Sheets

AUTOMATIC TOILET FLUSHING SYSTEM

BACKGROUND OF THE INVENTION

1. Field of the Invention

This invention relates in general to certain new and useful improvements in automatic toilet flushing systems and, more particularly, to an improved automatic toilet flushing system for use with toilets in private dwelling structures and also for use with conventional toilets.

2. Brief Description of the Related Art

There have been a large number of proposed automatic toilet flushing systems for use in various commercial and industrial establishments. As an example, automatic toilet flushing systems which cause the automatic flushing operation of a toilet after a user leaves the immediate proximity of the toilet is frequently found in hotels, airports, train stations, and like public use facilities.

The commercially available automatic toilet flushing systems generally operate on the principle of using a beam of radiation which can be interrupted to initiate a circuit operation and when the interruption, such as the person using the toilet system, removes himself from the interrupting position, a control circuit causes a flushing operation. As a simple example, an infrared beam may be located in a position adjacent a mens' urinal, such that when a user walks up to the urinal, the radiation beam is interrupted. When the user removes himself from the position adjacent to the urinal, the beam is re-established and initiates a flushing operation.

Automatic toilet flushing systems of this type have been found to be effective in these commercial and industrial environments, as aforesaid. However, it may be appreciated that these toilet flushing systems are generally complex and costly. In many cases, the toilet flushing devices are operated so as to preclude a flushing for a predetermined number of uses. They may also preclude flushing unless beam interruption occurred for a selected time period. While some of these features may be effective for a commercial or industrial use, they are not typically effective for a private dwelling environment. One such system which uses a programmable flushing delay circuit is taught in U.S. Pat. No. 5,235,706, dated Aug. 17, 1993, by Allen, et al.

Other types of automatic toilet flushing systems, primarily adapted for commercial and industrial environments, have been taught, for example, in U.S. Pat. No. 4,309,781, dated Jan. 12, 1982. The system taught in this particular '781 patent utilizes pulses located within a defined viewing area and a lens system arranged to collect reflected light in order to activate a control circuit. Generally, all automatic flushing systems have been used with urinals located in mens' toilet facilities, or so-called "rest rooms". The typical urinal is mounted against the wall and, compared to a standard toilet, is located in very close proximity to the wall. Moreover, sensors are mounted on the plumbing fixtures or on the sides of the urinal and readily and easily detect the present of an individual walking up to and standing before the urinal.

In the case of a standard toilet, the toilet is used by men who may stand in front of the toilet or by both men and women who may sit on the toilet. However, no standard toilet has heretofore been equipped with an automatic flushing system. Indeed, there has not been any design of a flushing system which can be used with a standard toilet. Even more importantly, in order to make any conventional toilet into an automatic flushing toilet, it is necessary to completely remove the existing structure and install a new structure therefor. It can be observed that the devices taught in both the aforesaid '781 and in the aforesaid '706 patent are both used with fixed urinals and, hence, there is no difficulty in locating radiation beams which can be interrupted for initiation of operation. Thus, and with a commercially available urinal, there is no toilet lid opening and closing which could otherwise interfere with operation. Moreover, since the user of the urinal typically stands at a known distance, generally within defined limits, the beams can be positioned so as to be properly interrupted and cause an activation of the flushing system.

A battery operated automatic toilet flushing system has also been disclosed in U.S. Pat. No. 5,169,118, dated Dec. 8, 1992, entitled "Solenoid-Operated Battery-Powered Flush Valve". In this particular system, the valve itself is actually powered by a battery and also uses infrared sensors connected to the battery along with a solenoid operable valve mechanism. However, the system taught in the '118 patent is again designed for commercial or industrial type toilet or urinal use.

Heretofore, there has not been any system which is provided for use with home toilets or other toilets found in a private dwelling facility. Moreover, there has not been any commercially available system which uses automatic flushing and which is adaptable for use in toilets in private dwelling structures. It would be desirable to provide an automatic toilet flushing system for use with toilets in private dwelling structures for a variety of reasons. Very frequently, many parties suffer temporary or permanent disabilities which may preclude easy access to a toilet handle usually located at some depth rearwardly of the toilet seat. In other cases, forgetfulness or lack of attentiveness of impaired individuals may prevent their manual flushing of the toilet. In these and other situations, an automatic toilet flushing system for private dwelling structures would be a significant advantage.

In many cases, governmental regulations now require the use of facilities which meet certain health standards. Thus, a toilet operation which did not require engagement of a handle would have particular attractiveness in these types of environments.

There has also been no commercially available adaptation which can be used with a conventional toilet in order to convert that toilet into one which is capable of automatically flushing after use. Such an adaptation would be highly desirable in order to save the substantial cost of removing and reinstalling a completely new toilet fixture with an automatic flushing feature. Furthermore, such an adaptation would enable easy and relatively inexpensive compliance with various governmental requirements, such as the the U.S. Government Aid for Disabilities Act.

OBJECTS OF THE INVENTION

It is one of the primary objects of the present invention to provide an automatic toilet flushing system adapted for application to a conventional toilet having an upstanding water chest.

It is another object of the present invention to provide an automatic toilet flushing system of the type stated which can be adapted for use with conventional toilet systems in private dwelling structures.

It is a further object of the present invention to provide a home use automatic toilet flushing system of the type stated which uses infrared beams for sensing the presence and the departure of an individual and which is not encumbered by use of a raiseable toilet seat.

It is an additional object of the present invention to provide a home automatic toilet flushing system of the type stated which can be used with conventional toilets without any significant revision of the toilets.

It is still another salient object of the present invention to provide an automatic toilet flushing system of the type stated which can be used with toilets in dwelling structures and which is highly efficient in operation and can be retrofitted at a relatively low cost.

It is still a further object of the present invention to provide a method for adapting a toilet facility in a dwelling structure for automatic flushing.

With the above and other objects in view, my invention resides in the novel features of form, construction, arrangement and combination of parts and components presently described and pointed out in the claims.

SUMMARY OF THE INVENTION

An automatic toilet flushing system adapted for use with conventional toilets of the type having a water chest or so-called "water tank" for providing flushable water to a toilet bowl. The present invention also provides an automatic flushing toilet system for use in dwelling structures. The flushing system of the invention is effective in that it can be used as a so-called "retrofit device" for application to an existing toilet in order to render a convention toilet into an automatic flushing toilet.

Typically, the conventional toilets of the type with which the invention can be used are usually those which contain a toilet bowl and a water chest located immediately rearwardly of the toilet bowl and which is adapted for supplying water to the toilet bowl when the latter is flushed. Generally, the conventional toilet constructions utilize the water chest with a flushing mechanism incorporated therein. This flushing mechanism includes a flapper valve at the lower end of the water chest which is openable and closable in response to actuation of a toilet flushing handle. Moreover, a tank lid is removably disposed over the upper end of the water chest.

In accordance with the present invention, there is provided an adaptive system which is operable with a conventional toilet for converting that conventional toilet to an automatic flushing toilet. In accordance with this adaptive system, the tank lid on the water chest for the toilet is replaced with a tank lid or so-called "cover plate" forming part of the adaptive system of the invention. The tank lid forming part of the adaptive system includes forwardly projecting end portions with means for generating beams of radiation, e.g., infrared radiation, as well as sensors located to sense interruption of radiation beams. Thus, the radiation generating sources at each of the opposite projections on the adaptive water tank lid are located so as to direct a beam of radiation, such as infrared radiation, to a point where a user would stand or sit while using the toilet.

When the generated beam of radiation, or for that matter, a narrow field of the infrared radiation, is interrupted as, for example, by an individual standing next to or sitting on the toilet, an electronic circuit, as hereinafter described, automatically will cause initiation of a flushing action after a predetermined time period when the beams from the two radiation sources are re-established in contact with one another or when the infrared field is no longer interrupted.

The sensors and sources of radiation on the projections of the adaptive water chest cover plate are located so that they will not be interrupted by the raising and lowering of a toilet seat on the toilet itself. Otherwise, a time delay is established, such that a flushing operation will not be initiated until the time period of interruption exceeds a certain a pre-established time. Thus, the simple the act of raising or lowering a toilet seat is too quick to enable a timing circuit to cause initiation of a flushing signal.

The system of the present invention may also provide adjustability so that the positioning of the sensors and sources of radiation can be adjusted to accommodate either the standard round-shaped toilet or otherwise the oval shaped or so-called elongate toilet.

The system of the invention is essentially mounted on the underside of the adaptive replaceable water chest cover plate. In this case, a circuit is mounted on the underside of the adaptive system cover plate and is connected to the sensors and radiation sources. This circuit is designed to sense a braking or interruption of the beams of radiation, such as infrared light, and which initiates an interruption signal for the circuit. The circuit thereupon starts a count for a time delay. If that time delay reaches a pre-established time period as, for example, two seconds or eight seconds, then re-establishment of the contact of the two beams will initiate a flushing signal and thereby cause a flushing action. This time period is established so that the circuit will effectively recognize the presence of an individual who may have been standing at or sitting on the toilet and then leaves that immediate area, as opposed to some other type of interruption as, for example, a temporary interruption of less than two seconds.

After the flushing signal has been initiated, a solenoid mechanism is actuated and which causing the shifting movement of a rod or other mechanism which is, in turn, connected to the flapper valve at the lower end of the water chest. In this way, interruption of the radiation beams for a predetermined period and then a re-contact of those beams will initiate a complete flushing of the toilet.

Inasmuch as there are various types of home use toilets available as, for example, those which use five gallon water flushings, those which use three and one-half gallon water flushings, and those which use approximately one and one-half gallon water flushings, adjustment in the time of actuation of the solenoid mechanism must also be provided. In this way, the solenoid mechanism would have remain energized for a sufficiently long time period in order to enable all of the flushing water within the tank to be dispensed to the toilet bowl.

The adaptive system of the present invention is highly unique and effective in that it does not require a completely new toilet in order to convert a toilet to an automatic flushing toilet. In this case, it is only necessary to replace the tank lid of the water chest with a system of the present invention and to connect the flapper valve of the existing toilet to the solenoid forming part of the system.

In accordance with the above-identified construction, a conventional toilet can be converted to an automatic flushing toilet at a relatively low cost and without the necessity of purchasing a completely new toilet, and without the expense and time involved for installation of a new toilet.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention. However, it is to be understood that the following detailed description and the accompanying drawings are not to be taken in a limiting sense.

BRIEF DESCRIPTION OF THE DRAWINGS

Figure 1:
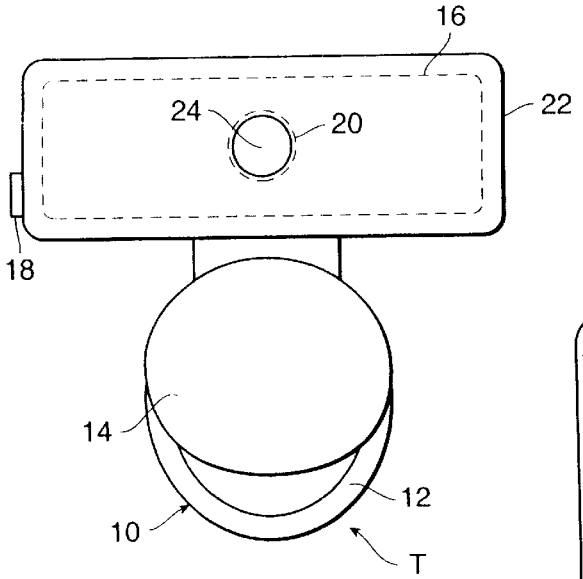
Figure 2:
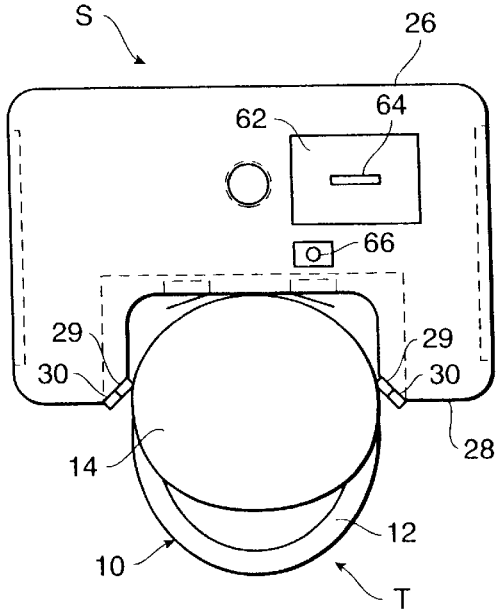
Figure 3:
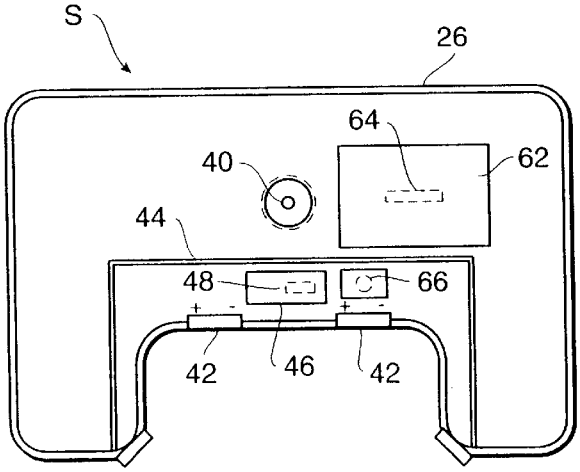
Figure 4:
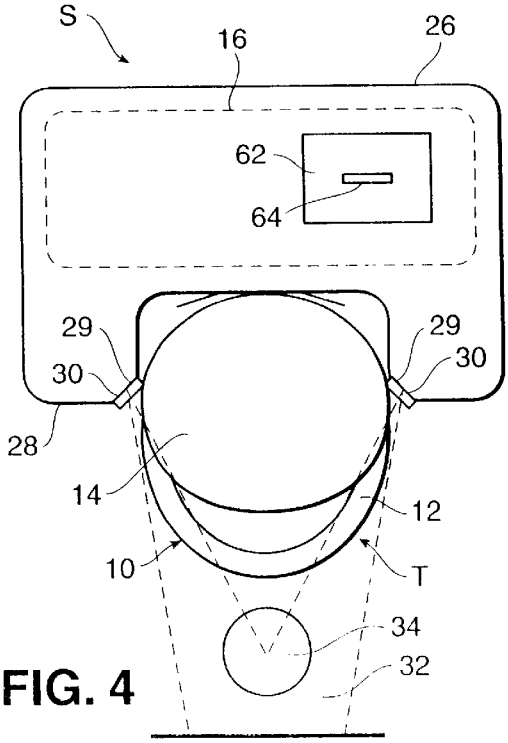
Figure 7:
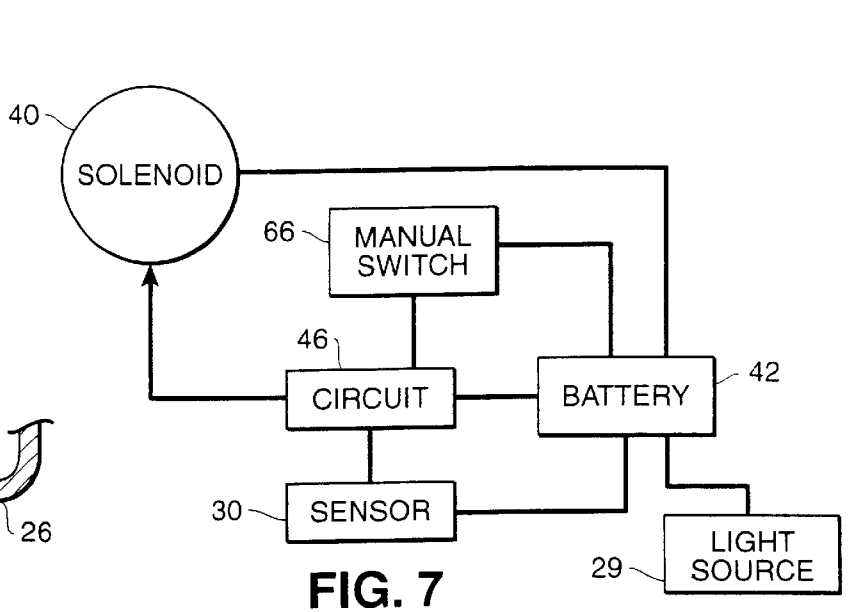
Figure 6:
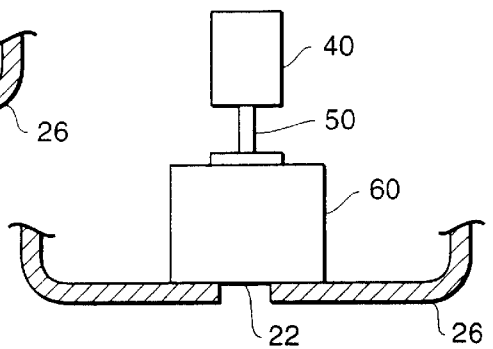
Figure 5:
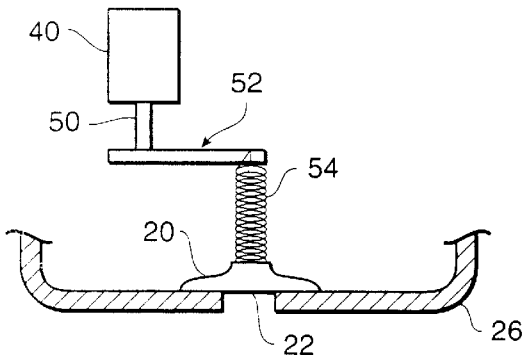
Figure 8:
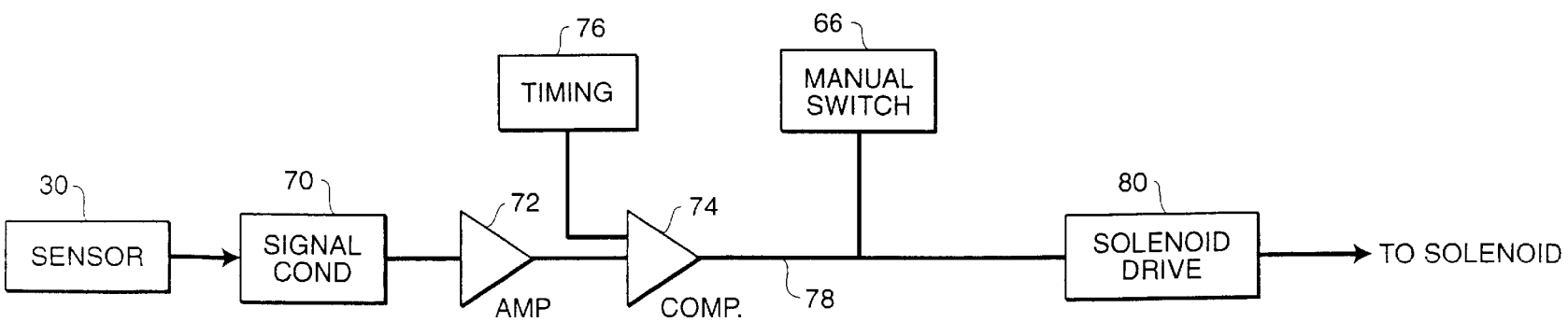

Having thus described the invention in general terms, reference will now be made to the accompanying drawings in which:

FIG. 1 is a top plan view of a toilet facility with which an automatic flushing system of the present invention can be used;

FIG. 2 is a top plan view of a toilet facility equipped with the automatic toilet flushing system of the present invention;

FIG. 3 is a bottom top plan view of a cover plate used over the water chest of a toilet facility and showing the major operating components of the automatic toilet flushing system of the present invention;

FIG. 4 is a schematic top plan view showing the positioning of the beams of radiation generated with the automatic toilet flushing system of the present invention;

FIG. 5 is a schematic vertical sectional view showing the connection of a portion of the automatic toilet flushing system of the present invention to a flapper valve forming a part of a toilet construction;

FIG. 6 is a fragmentary sectional view, similar to FIG. 4, and showing a modified form of a toilet flushing system in accordance with the present invention;

FIG. 7 is a schematic circuit view showing the overall circuit components of the automatic toilet flushing system of the present invention; and FIG. 8 is a more detailed schematic circuit view showing a portion of the electrical circuit forming part of the system of the present invention.

DETAILED DESCRIPTION OF A PREFERRED EMBODIMENT

Referring now in more detail and by reference characters to the drawings, which illustrate a preferred embodiment of the present invention, T designates a conventional toilet with which the adaptive automatic toilet flushing system S of the present invention may be used. The conventional toilet T comprises a toilet bowl 10 and which is frequently provided on its upper rim with a toilet seat 12 having a hingedly closeable and openable lid 14. The conventional toilet is also provided with a water chest or so-called "water tank" 16, usually located immediately rearwardly of and above the bowl 10. In this way, water is allowed to drain from the water chest by the force of gravity directly into the toilet bowl 10 through conventional plumbing connections.

The conventional toilet T is also preferably provided with a flushing handle 18 normally located on the water chest 16 and which operates a flushing mechanism (not shown) located within the water chest. This flushing mechanism typically comprises a flapper valve 20 located at the lower end of the water chest and can be openable and closed with respect to a water outlet 24 covered by the flapper valve for releasing water into the toilet bowl 10. Generally, a chain mechanism connects the flapper valve 20 to the flushing handle 18.

The conventional water chest forming part of the toilet T is also provided with a removable tank lid 22. Usually this tank lid is merely disposed on the upper rim of the water chest and allows access to the interior for purposes of repair or adjustment. In accordance with the present invention, a substitute cover plate (sometimes referred to herein as "tank lid") 26 is provided and which forms part of the adaptive system S of the present invention.

The cover plate or lid 26 also fits upon the upper rim of the water chest 16 and is retained thereon by the force of gravity, much in the same manner as the original cover plate 22. However, while the original cover plate 22 was generally rectangular in shape, the cover plate 26 is provided with a pair of forwardly extending sections or protrusions 28 along each of the opposite sides of the toilet bowl 10, in the manner as best shown in FIGS. 2 and 4 of the drawings. Thus, the cover plate 26, to some extent, extends around the rear and a portion of the sides of the toilet bowl 10 and the toilet seat 12, as well as the lid 14.

Located on each of the protrusions 28 and being angularly disposed to one another are a pair of infrared light generating sources 29 and light sensors 30, as also best shown in FIG. 2. In effect, these light generating sources 30 are provided with a light generator mechanism (not shown) to cause the generation of infrared beams. In the illustrated embodiment, a separate light generating source 29 and a separate light sensor 30 are provided on each of the protrusions 28. However, it should be understood that the sensors and the light generating sources could be combined in a single unit, if desired. Moreover, it should be understood that the radiation which is used is not necessarily limited to infrared radiation and could be visible light radiation or other wave lengths of radiation.

The light generator sources 30 are located so that they generate a beam path 32, substantially as shown in FIG. 4 of the drawings. Thus, by reference to FIG. 4, it can be seen that the beam path 32 is located so that it can be interrupted by an individual or any other object, identified by reference numeral 34 located in front of the toilet bowl 10. Thus, in the case of a man who desires to urinate in the toilet bowl 10, he typically stands at a position in front of the bowl 10 generally in the same position as the object 34 identified in FIG. 4. An individual also sitting on the toilet seat 12 would similarly be in a position of interrupting the light path.

As this individual or other object is moved into the beam path 32, the electronic circuit forming part of the system of the present invention is actuated, as hereinafter described, to cause an automatic flushing of the toilet upon removal of the person or other object 34 from this beam path 32.

Adjustment knobs or the like can also be provided on or with respect to the sensor or the light source, or both, in order to accommodate the shape of the toilet bowl. Thus, for the standard circularly shaped toilet, the position of the light beams and the position of the sensors would be different than for those toilets which are oval shaped or so-called elongate toilets. Also, different models could be provided for each type of toilet, or otherwise adjustment knobs or screws could be provided to allow adjustment for the particular size of the toilet.

The adaptive system S of the present invention includes the major portion of the components enabling the automatic flushing to be mounted on the underside of substitute cover plate 26. In this respect, the automatic flushing mechanism forming part of the adaptive system S comprises a solenoid 40 which is operable by a pair of batteries 42 located in a battery compartment 44 formed on the underside of the substitute cover plate 26, all in the manner as best shown in FIG. 3 of the drawings. A control circuit 46 is located in the battery compartment 44 and is electrically connected to the batteries 42 for operation thereof. The control circuit is also electrically connected to the electrically operable solenoid 40.

The control circuit 46 actually includes a time delay circuit 48 schematically shown as forming part of the control circuit 46. The control circuit will cause initiation of a count by the time delay circuit 48 after the beam path 32 is interrupted as, for example, by an object 34. If the time delay circuit 48 reaches a count equivalent to a predetermined time period of, e.g. two to three seconds, then the control circuit is initiated. However, no flushing operation will take place until the beam path is again re-established, that is, when the person or other object 34 is removed from the path of the beam. After this person or other object is so removed from the path of the beam, the control circuit 46 will cause the initiation of a flush signal which is delivered to the solenoid 40 for initiation of a flushing of the toilet.

The electrically operable solenoid 40 includes a solenoid shaft 50 which is, in turn, connected to an actuating mechanism 52. This actuating mechanism includes either an actuating rod or otherwise a chain 54 connected to the tank flapper valve 20. In any event, when the solenoid 40 is actuated, the solenoid shaft 50 will retract within the solenoid 40 pulling the chain 54 and the flapper valve 20 upwardly allowing water within the water chest 16 to flush through the valve outlet 24 and into the toilet bowl.

It is also possible to provide an adjusting mechanism on the solenoid in order to control the amount of time that the solenoid remains energized and, hence, the amount of time in which the flapper valve of the toilet will be opened. There are presently in use toilets which flush with approximately three and one-half gallons and those which flush with approximately five gallons, as well as those which flush with approximately one and one-half gallons. In each case, the amount of time which the flapper valve remains open will differ to allow all of the flushing water to be dispensed into the toilet bowl. In this case, the adjustment could be provided on the solenoid so that the amount of time which the solenoid remains energized can be set for each particular type of toilet. Otherwise, individual solenoids having pre-set time periods could also be provided in accordance with the present invention.

FIG. 6 illustrates a modified form of system which uses pressure assists commonly found in many conventional toilets. In this particular case, the solenoid 40 would have the solenoid shaft 50 connected directly to a pressure tank flushing mechanism schematically illustrated as 60 in FIG. 6. Inasmuch as these pressure tank mechanisms are conventional in construction, they are neither illustrated nor described in any further detail herein. However, upon actuation of the pressure tank mechanism 60, the valve opening 24 would be opened allowing an escape of water in the water chest 16.

In order to enable connection of the solenoid 40, which is mounted on the underside of the cover plate 26, a manually openable access cover 62 is provided on the cover plate 26. Thus, the access cover 62 can be removed by engagement of a handle 64, such that one can connect the flushing mechanism in the water chest directly to the solenoid shaft 50. Beyond this, it is only necessary, if at all, to disconnect the manually operable flushing handle 18 from the flushing mechanism. In accordance with this construction, a conventional toilet can be easily modified with the adaptive system to become an automatic flushing toilet.

A manually operable push button switch 66 is also mounted on the upper surface of the adaptive cover plate 26. This push button switch 66 would be effectively electrically operated and connected to the control circuit 46 for automatically initiating a flushing operation when the switch 66 was closed. This switch 66 would also operated through the battery source of power 42.

FIG. 7 illustrates the major components forming part of the electronic control circuit of the present invention. In this respect, it can be observed that all of the components are effectively electrically operated through the battery source of power 42. In this respect, the light sources are very low intensity sources and the remaining components use only a very small amount of electric power.

FIG. 8 represents a more detailed version of the electric circuit, as shown in the FIG. 7, and which forms a part of the control circuit 46. In this case, it can be seen that each of the sensors 30 provide outputs into signal conditioning circuits 70 and also into an amplifier 72 for amplifying the relatively low level signal from the sensor 30. The signal from the amplifier is introduced into a comparator 74 which receives a timing signal from a timing circuit 76. If the signal from the signal conditioning circuit 70 and, hence, through the amplifier 72 exceeds the time period established by the timing circuit 76, then the comparator passes a flushing initiation signal over the line 78. However, if the signal from the amplifier 72 does not exceed the pre-established time period signal from the timing circuit 76, the comparator 74, which is in the form of a gate, does not issue any flushing signal. In this respect, the timing circuit 76 may adopt that form of timing circuit 48, as shown in FIG. 3.

The flushing initiation signal is then introduced into a solenoid driving circuit 80 which may actually form part of the control circuit 46. This solenoid driving circuit 80 serves to increase the voltage to the solenoid 40 for operation of same. Beyond this, the remaining portion of the operation of the system has been described.

The system of the present invention is highly effective in not only eliminating the need for individuals to touch any implement of the toilet, but it is also effective in complying with various governmental regulations. In the United States, for example, the American Disabilities Act mandates certain health requirements, particularly for disabled persons. Thus, the system of the present invention allows toilets in restaurants, hospitals, hotels and the like to be easily converted to an automatic flushing toilet.

Thus, there has been illustrated and described a unique and novel automatic toilet flushing system which is adapted for use on existing toilets as a retrofit device, and which is also capable of being used in private dwelling establishments. The adaptive automatic flushing system of the invention therefore fulfills all of the objects and advantages which have been sought. It should be understood that many changes, modifications, variations and other uses and applications which will become apparent to those skilled in the art after considering the specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A retrofit adaptive system for converting a conventional toilet having a toilet bowl and water chest associated therewith into an automatically flushable toilet, said adaptive system comprising:

a) a plate substitutable for a conventional cover plate originally provided over the water chest on the conventional toilet, said plate having forwardly protruding portions;

b) field generating means on said plate and generating a radiation field extending outwardly therefrom and forwardly of said water chest;

c) sensor means mounted on at least one of said portions and being located to detect the presence of said radiation field forwardly of said toilet bowl; and d) circuit means for initiating a flushing signal and causing an automatic flushing of the toilet in response to an interruption of said field of radiation after a predetermined time period.

2. The retrofit adaptive system of claim 1 for converting a conventional toilet into an automatically flushable toilet further characterized in that said sensor means and said field generating means are located on a forward portion of the plate and said circuit means is mounted on an underside of said plate.

3. The retrofit adaptive system of claim 1 for converting a conventional toilet into an automatically flushable toilet further characterized in that said plate is a water chest cover plate substituted for a conventional water chest cover plate and said circuit means is located on a underside of said plate.

4. The retrofit adaptive system of claim 1 for converting a conventional toilet into an automatically flushable toilet further characterized in that said field generating means for generating a field of radiation in relation to the sensors and said sensors are also located on at least one of said portions.

5. The retrofit adaptive system of claim 1 for converting a conventional toilet into an automatically flushable toilet further characterized in that said system comprises a solenoid operable mechanism which is operatively connected to a flushing mechanism of said toilet and the initiation of the flushing signal causes operation of said solenoid operable mechanism.

6. The retrofit adaptive system of claim 5 for converting a conventional toilet into an automatically flushable toilet further characterized in that said solenoid operable mechanism is mounted on or carried by an underside of said plate.

7. The retrofit adaptive system of claim 1 for converting a conventional toilet into an automatically flushable toilet further characterized in that said system comprises a time delay means operating in conjunction with said circuit means and mounted on the underside of said plate in order to determine if the field of radiation has been interrupted for at least a predetermined time period before initiating any flushing operation and that a flushing operation will not be initiated if the field has not been interrupted for at least said predetermined time period.

8. The adaptive system of claim 1 for converting a conventional toilet into an automatically flushable toilet further characterized in that said sensor means is operated and said circuit means is operated by a source of battery power.

9. A retrofitted toilet for use in a private dwelling environment and which is automatically flushable after a user of the toilet leaves the proximity of the toilet, said retrofitted toilet comprising:

a) a toilet bowl;

b) a water chest with means for providing water to the toilet bowl for flushing same;

c) a plate associated with said water chest having been substituted for a conventional plate originally provided on said water chest, said plate having forwardly extending protrusions;

d) means for generating a field of radiation forwardly of said toilet bowl used for detecting the presence of the person who may use said toilet;

e) sensor means located on one of said protrusions for detecting the presence of a person or object who may interrupt said beam of radiation; and f) automatic flush initiating means for initiating a flushing operation of said toilet when said beam has been interrupted.

10. The toilet of claim 9 further characterized in that said plate associated with said water chest comprises a removable cover plate disposed over said water chest and said sensor means is located on each of said forwardly extending protrusions.

11. The toilet of claim 9 further characterized in that said means for initiating a flushing operation comprises a control circuit which enables the generation of a flush initiation signal in response to detection of the presence of an object or person, and solenoid operable means for causing a flushing action of the toilet.

12. The toilet of claim 9 further characterized in that said system comprises a time delay means for determining if the interruption of said radiation beam occurred for at least a predetermined time period and which precludes a flushing operation if the interruption did not occur for said predetermined time period.

13. The toilet of claim 9 further characterized in that the means for initiating a flushing operation also comprises an air assist flushing unit.

14. The toilet of claim 9 further characterized in that battery means is provided for operating any electrical components forming part of said toilet.

15. A method of converting a manually flushable toilet of the type having a toilet bowl and a water chest for delivery of flushing water to the toilet bowl into an automatically flushable toilet, said method comprises:

a) replacing a water chest tank lid on the water chest of said toilet with a substitute cover plate having forwardly protruding portions;

b) initiating a radiation field forwardly of said toilet bowl and water chest;

c) sensing an interruption in said radiation field with sensors located on said forwardly protruding portions; and d) automatically initiating a flushing cycle after said radiation field has been interrupted.

16. The method of converting a manually flushable toilet of claim 15 further characterized in that said method comprises determining whether a time delay occurred from the commencement of the interruption of that radiation field and which exceeded a predetermined period and automatically preventing a flushing if the interruption did not exceed said predetermined time period.

17. An adaptive system for converting a conventional manually flushable toilet having a toilet bowl and water chest associated therewith into an automatically flushable toilet, said adaptive system comprising:

a) an adaptive system cover plate for use with the conventional toilet and which is substitutable and replaces a conventional cover plate over the water chest of the conventional toilet;

b) protrusions on said plate and extending outwardly therefrom and forwardly of said water chest;

c) sensor means mounted on at least one of said protrusions and being located to detect the presence of a radiation field forwardly of said toilet bowl; and d) circuit means for initiating a flushing signal and causing an automatic flushing of the toilet in response to an interruption of said field of radiation after a predetermined time period.

18. The adaptive system of claim 17 for converting a conventional manually flushable toilet into an automatically flushable toilet further characterized in that said system comprises means for generating a field of radiation and sensors located with respect to the field of radiation and which means for generating the field of radiation is also located on a protrusion extending forwardly of said water chest.

19. The adaptive system of claim 17 for converting a conventional manually flushable toilet into an automatically flushable toilet further characterized in that said system comprises a solenoid operable mechanism which is operatively connected to a flushing mechanism of said toilet and the initiation of a flushing signal from said circuit means causes operation of said solenoid operable mechanism.

20. The adaptive system of claim 19 for converting a conventional manually flushable toilet into an automatically flushable toilet further characterized in that said solenoid operable mechanism and said circuit means are both mounted on or carried by an underside of said plate.

21. An adaptive system for converting a conventional toilet having a toilet bowl and a water chest associated therewith along with a flushing mechanism in said toilet into an automatically flushable toilet, said adaptive system comprising:

a) a plate for use with the conventional toilet;

b) protrusions on said plate and extending outwardly therefrom and forwardly of said water chest;

c) sensor means mounted on at least one of said protrusions and being located to detect the presence of a radiation field forwardly of said toilet bowl;

d) circuit means for initiating a flushing signal and causing an automatic flushing of the toilet in response to an interruption of said field of radiation after a predetermined time period; and e) a solenoid operable mechanism operatively associated with said circuit means and which is mounted on or carried by an underside of said plate, said solenoid operable mechanism being operatively connected to said flushing mechanism of said toilet and being operable so that the initiation of a flushing signal causes operation of said solenoid operable mechanism.

22. The adaptive system of claim 21 for converting a conventional manually flushable toilet into an automatically flushable toilet further characterized in that an adaptive system cover plate is substitutable for a conventional cover plate initially provided over the water chest on the conventional toilet and has a pair of forwardly extending protrusions thereon carrying said sensor means.

23. The adaptive system of claim 21 for converting a conventional manually flushable toilet into an automatically flushable toilet further characterized in that said system comprises a time delay means in order to determine if the field of radiation has been interrupted for at least a predetermined time period before initiating any flushing operation and that a flushing operation will not be initiated if the field has not been interrupted for at least said predetermined time period.

24. A toilet for use in a private dwelling environment and which is automatically flushable after a user of the toilet leaves the proximity of the toilet, said toilet comprising:

a) a toilet bowl;

b) a water chest with means for providing water to the toilet bowl for flushing same;

c) a removable cover plate disposed over said water chest cover and having forwardly extending protrusions thereon;

d) means for generating a field of radiation forwardly of said toilet bowl for use in for detecting the presence of the person who may use said toilet;

e) sensor means located on each of said forwardly extending protrusions so that each said sensor means is located forwardly of said water chest for detecting the presence of a person or object which may interrupt said beam of radiation; and f) automatic flush initiating means for initiating a flushing operation of said toilet when said beam has been interrupted.

* * * * *